US006686138B1

(12) United States Patent
Gisser

(10) Patent No.: US 6,686,138 B1
(45) Date of Patent: Feb. 3, 2004

(54) COLOR MOTION PICTURE PRINT FILM WITH IMPROVED RAW STOCK KEEPING

(75) Inventor: Kathleen R. C. Gisser, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/331,394

(22) Filed: Dec. 30, 2002

(51) Int. Cl.[7] ..... G03C 1/34; G03C 1/85; G03C 1/89

(52) U.S. Cl. ..... 430/505; 430/510; 430/517; 430/527; 430/530; 430/551; 430/608

(58) Field of Search ..... 430/608, 551, 430/527, 530, 505, 510, 517

(56) References Cited

U.S. PATENT DOCUMENTS

| | | | | |
|---|---|---|---|---|
| 4,073,652 | A | 2/1978 | Florens | |
| 4,203,769 | A | 5/1980 | Guestaux | 430/530 |
| 5,006,451 | A | 4/1991 | Anderson et al. | 430/530 |
| 5,096,804 | A | 3/1992 | Ikenoue et al. | 430/608 |
| 5,221,598 | A | 6/1993 | Anderson et al. | 430/530 |
| 5,368,995 | A | 11/1994 | Christian et al. | 430/530 |
| 5,650,265 | A | 7/1997 | Sniadoch et al. | 430/530 |
| 5,679,505 | A | 10/1997 | Tingler et al. | 430/530 |
| 5,723,272 | A | 3/1998 | Barber et al. | 430/527 |
| 6,197,485 | B1 | 3/2001 | Cellone et al. | 430/608 |

*Primary Examiner*—Richard L. Schilling
(74) *Attorney, Agent, or Firm*—Andrew J. Anderson

(57) ABSTRACT

A silver halide light sensitive motion picture photographic print element comprising a support having a front side and a back side and bearing on the front side thereof in order a yellow dye image-forming unit comprising at least one blue-sensitive silver halide emulsion layer having associated therewith at least one yellow dye-forming coupler, a cyan dye image-forming unit comprised of at least one red-sensitive silver halide emulsion layer having associated therewith at least one cyan dye-forming coupler, and a magenta dye image-forming unit comprising at least one green-sensitive silver halide emulsion layer having associated therewith at least one magenta dye-forming coupler; said element further comprising an antistatic layer containing vanadium pentoxide on either side of the support, and a raw stock keeping stabilizer compound present in at least one emulsion layer or a hydrophilic colloid layer in reactive association with at least one emulsion layer, wherein the stabilizer compound comprises $Au_2S$ or a tetrachloroaurate (3+) salt of the formula $MAuCl_4$ where M represents H, Na, or K at a total coverage of at least 0.05 mg/m$^2$. The photographic print elements of the invention improve keeping performance demonstrated by print elements which comprise vanadium pentoxide containing antistatic layers.

18 Claims, No Drawings

COLOR MOTION PICTURE PRINT FILM WITH IMPROVED RAW STOCK KEEPING

FIELD OF THE INVENTION

The invention relates to a color motion picture print silver halide photographic film, and more particularly to such a film having a vanadium pentoxide containing antistatic layer and which has desirable raw stock keeping performance.

BACKGROUND OF THE INVENTION

Photographic elements may be susceptible to general fog formation or sensitivity loss when they are stored for an extended period of time in conditions of high temperature and humidity. The term "raw stock keeping" is used to refer to photographic performance changes which may occur between coating of a photographic element and actual use thereof. Various compounds have been disclosed for use as stabilizing agents in photographic elements to improve raw stock keeping performance.

The photographic industry has also long recognized the need to provide photographic films and papers with antistatic protection to prevent the accumulation of static charges during manufacture and use. Such protection is advantageous in photographic elements as static charges can cause irregular fog patterns in photographic silver halide imaging emulsions. Static charges are also undesirable because they attract dirt to the photographic element and this can cause repellency spots, desensitization, fog and physical defects. To prevent the problems arising from an accumulation of static charges, it is a conventional practice to provide an antistatic layer (i.e., a conductive layer) in a photographic element.

Photographic elements further typically comprise some form of antihalation protection. Halation has been a persistent problem with photographic films comprising one or more photosensitive silver halide emulsion layers coated on a transparent support. The emulsion layer diffusely transmits light, which then reflects back into the emulsion layer from the support surface. The silver halide emulsion is thereby re-exposed at locations different from the original light path through the emulsion, resulting in "halos" on the film surrounding images of bright objects.

One method proposed for antistatic and antihalation protection in photographic films comprises providing a dyed or pigmented layer behind a clear support as an antihalation backing layer, wherein the backing layer is designed to be removed during processing of the film. Typical examples of such antihalation backing layers comprise a light absorbing dye or pigment (such as carbon black) dispersed in an alkali-soluble polymeric binder (such as cellulose acetate hexahydrophthalate) that renders the layer removable by an alkaline photographic processing solution. Such carbon containing "rem-jet" backing layers have been commonly used for antihalation protection in motion picture films. The carbon particles additionally provide antistatic protection prior to being removed. While such rem-jet backing layers provide effective antihalation and antistatic protection for photographic films prior to processing, their use requires special additional processing steps for their subsequent removal, and incomplete removal of the carbon particles can cause image defects in the resulting print film. Additionally, it is often desirable to provide "process surviving" antistatic protection for photographic elements in order to prevent static build-up even after imagewise exposure and processing, especially for motion picture films which are subject to rapid transport through projection apparatus where static charges can attract dust particles which may detrimentally impact a projected image.

An alternative to the use of rem-jet backing layers is to use an antihalation layer or layers containing filter dye or silver metal coated between the support and the emulsion layers, wherein the filter dye or silver is solubilized and removed and/or decolorized during processing of the film, and a separate process-surviving antistatic backing layer. Process-surviving antistatic layers typically include, e.g., ionic polymers, electronic conducting non-ionic polymers, and metal halides or metal oxides in polymeric binders. Conductive fine particles of crystalline metal oxides dispersed with a polymeric binder have been found to be especially desirable for preparing optically transparent, humidity insensitive, antistatic layers for various imaging applications. Many different metal oxides, such as AnO, $TiO_2$, $ZrO_2$, $Al_2O_3$, $SiO_2$, MgO, BaO, $MoO_3$, and $V_2O_5$, are disclosed as useful as antistatic agents in photographic elements or as conductive agents in electrostatographic elements in such patents as U.S. Pat. Nos. 4,203,769, 4,275,103; 4,394,441; 4,416,963; 4,418,141; 4,431,764; 4,495,276; 4,571,361; 4,999,276; and 5,122,445. The use of metal oxide materials is further advantageous, as their antistatic properties allow the use of a protective overcoat layer to provide abrasion protection and/or enhance frictional characteristics while still providing acceptable antistatic performance. Antistatic layers which contain vanadium pentoxide have been found to provide excellent protection against static and are highly advantageous in that they have excellent transparency and their performance is not significantly affected by changes in humidity.

Relatively small grain, high chloride emulsions (e.g., emulsions having average grain size equivalent circular diameters of less than about 1 micron and halide contents of greater than 50 mole % chloride) are typically used in photographic print films and papers in order to optimize print image quality and enable rapid processing. Such emulsions typically result in relatively low speed photographic elements in comparison to camera negative films. Low speed is compensated for by the use of relatively high intensity print lamps or lasers for exposing such print elements. For comparison purposes, it is noted that print films and papers, such as motion picture color print films, e.g., when rated using the same international standards criteria used for rating camera negative films, would typically have an ISO speed rating of less than 10, which is several stops slower than the slowest camera negative films in current use. Such photographic print elements generally have been found to be far less susceptible to product performance changes upon storage under high humidity conditions than camera negative films. It has been found by Applicants, however, that even such relatively low speed silver halide photographic print elements can surprisingly exhibit raw stock keeping performance changes under even moderate humidity storage conditions when vanadium pentoxide particles are used in an antistatic layer.

In U.S. Pat. No. 5,650,265, palladium compounds are disclosed specifically for use in photographic print elements which comprise antistatic layers containing vanadium pentoxide, in order to improve unexpected poor keeping performance for such elements. While palladium compounds work well in such elements for such purpose, palladium is significantly more expensive than other noble metals. Accordingly, it would be desirable to provide alternatives to the use of palladium compounds as raw stock keeping stabilizing compounds in photographic print elements which comprise antistatic layers containing vanadium pentoxide.

SUMMARY OF THE INVENTION

In accordance with one embodiment, the present invention is directed towards a silver halide light sensitive motion picture photographic print element comprising a support having a front side and a back side and bearing on the front side thereof in order a yellow dye image-forming unit comprising at least one blue-sensitive silver halide emulsion layer having associated therewith at least one yellow dye-forming coupler, a cyan dye image-forming unit comprised of at least one red-sensitive silver halide emulsion layer having associated therewith at least one cyan dye-forming coupler, and a magenta dye image-forming unit comprising at least one green-sensitive silver halide emulsion layer having associated therewith at least one magenta dye-forming coupler; said element further comprising an antistatic layer containing vanadium pentoxide on either side of the support, and a raw stock keeping stabilizer compound present in at least one emulsion layer or a hydrophilic colloid layer in reactive association with at least one emulsion layer, wherein the stabilizer compound comprises $Au_2S$ or a tetrachloroaurate(3+) salt of the formula $MAuCl_4$ where M represents H, Na, or K at a total coverage of at least 0.05 $mg/m^2$.

The photographic print elements of the invention improve keeping performance demonstrated by print elements which comprise vanadium pentoxide containing antistatic layers. The elements of the invention additionally provide excellent protection against static charge and excellent transparency due to the use of vanadium pentoxide, which properties are not significantly dependent on ambient humidity.

DETAILED DESCRIPTION

In color photographic element printing, there are usually three records to record in the image area frame region of a print film. Color photographic elements typically contain image dye-forming units sensitive to each of the three primary regions of the visible spectrum, i.e. blue (about 380 to 500 nm), green (about 500 to 600 nm), and red (about 600 to 760 nm) color sensitive records. Motion picture color print film photographic elements in accordance with the invention comprise a support bearing on the front side thereof, in order, a yellow dye image-forming unit comprising at least one blue-sensitive silver halide emulsion layer having associated therewith at least one yellow dye-forning coupler, optionally a first emulsion intercoat layer, a cyan dye image-forming unit comprised of at least one red-sensitive silver halide emulsion layer having associated therewith at least one cyan dye-forming coupler, optionally a second emulsion intercoat layer, and a magenta dye image-forming unit comprising at least one green-sensitive silver halide emulsion layer having associated therewith at least one magenta dye-forming coupler. Each unit may be comprised of a single light-sensitive layer, or two or more light-sensitive layers of varying light-sensitivity. Additionally, such elements include an antistatic layer containing vanadium pentoxide on either side of the support. In preferred embodiments, the antistatic layer is present on the back side of the support (i.e., side opposite to that of the emulsion layers), the elements may include an antihalation undercoat in a subbing layer unit between the support and the silver halide emulsion layers, an outermost protective overcoat layer over the silver halide emulsion layers, and an outermost protective backcoat layer over the antistatic layer on the back side of the support.

Materials which may be employed as the support member include synthetic high molecular weight polymeric materials. These materials may be comprised of various polymeric films, but preferred supports for elements in accordance with the invention comprise transparent polymeric films, such as cellulose nitrate and cellulose esters (such as cellulose triacetate and diacetate), polycarbonate, and polyesters of dibasic aromatic carboxylic acids with divalent alcohols such as poly(ethylene terephthalate), which are well known in the art. The thickness of the support is not critical. Conventional support member thicknesses of from about 50 to 250 microns (2 to 10 mils, or 0.002 to 0.010 inches) can be employed, for example, with very satisfactory results. Subbing layers coated between a support and the photographic imaging emulsion layers of a photographic element are conventionally employed in the art to provide improved adhesion of the imaging layers to the support, as well as other functionality such as antihalation or antistatic protection. As described in U.S. Pat. No. 4,132,552, e.g., it is often useful to employ a combination in the subbing layer unit of at least one hydrophobic "primer" layer directly contacting the film support and at least one hydrophilic layer coated thereupon. Polyester support members, e.g., typically employ a primer layer between the functional layers and the polyester support. Such primer layers are well known in the art and comprise, for example, a vinylidene chloride/methyl acrylate/itaconic acid terpolymer or vinylidene chloride/acrylonitrile/acrylic acid terpolymer as described in U.S. Pat. Nos. 2,627,088; 2,698,235; 2,698,240; 2,943,937; 3,143,421; 3,201,249; 3,271,178 and 3,501,301. Additional polymers useful as primer layers in a subbing layer unit include styrene-butadiene copolymers, water-soluble polyesters and polyacrylic esters. A hydrophilic layer may be coated adjacent to the primer layer in a subbing layer unit to provide good adhesion to hydrophilic colloid layers coated thereover, and may also include an aqueous latex dispersion, optionally containing a cross-linking agent, a swelling agent, a matting agent or an antistatic agent.

The silver halide emulsion layers of the dye-image forming units and any emulsion intercoat layers will comprise a hydrophilic binder, typically gelatin. Intercoat layers positioned between adjacent dye image-forming units of photographic elements function to separate and prevent image spread between the adjacent image-forming units.

Photographic light-sensitive print elements of the invention may utilize silver halide emulsion image forming layers wherein chloride, bromide and/or iodide are present alone or as mixtures or combinations of at least two halides. The combinations significantly influence the performance characteristics of the silver halide emulsion. Print elements are typically distinguished from camera negative elements by the use of high chloride (e.g., greater than 50 mole % chloride, preferably greater than 90 mole % chloride) silver halide emulsions containing no or only a minor amount of bromide (typically 0 to 40 mole %, preferably less than 5 mole % bromide) and/or iodide (typically 0–3 mole %, preferably 0–1 mole %). As explained in Atwell, U.S. Pat. No. 4,269,927,silver halide with a high chloride content possesses a number of highly advantageous characteristics. For example, high chloride silver halides are more soluble than high bromide silver halide, thereby permitting development to be achieved in shorter times. Furthermore, the release of chloride into the developing solution has less restraining action on development compared to bromide and iodide and this allows developing solutions to be utilized in a manner that reduces the amount of waste developing solution. Since print films are intended to be exposed by a controlled light source, the imaging speed gain which would be associated with high bromide emulsions and/or iodide incorporation offers little benefit for such print films.

Photographic print elements are also distinguished from camera negative elements in that print elements typically comprise only fine silver halide emulsions comprising grains having an average equivalent circular diameter (ECD) of less than about 1 micron, where the ECD of a grain is the diameter of a circle having the area equal to the projected area of a grain. The ECDs of silver halide emulsion grains are usually less than 0.60 micron in red and green sensitized layers and less than 1.0 micron in blue sensitized layers of a color photographic print element. Such fine grain emulsions used in print elements generally have an aspect ratio of less than 1.3, where the aspect ratio is the ratio of a grain's ECD to its thickness, although higher aspect ratio grains may also be used. Such grains may take any regular shapes, such as cubic, octahedral or cubo-octahedral (i.e., tetradecahedral) grains, or the grains can take other shapes attributable to ripening, twinning, screw dislocations, etc. Typically, print element emulsions grains are bounded primarily by {100} crystal faces, since {100} silver chloride grain faces are exceptionally stable. Specific examples of high chloride emulsions used for preparing photographic prints are provided in U.S. Pat. Nos. 4,865,962; 5,252,454; and 5,252,456, the disclosures of which are here incorporated by reference.

Photographic print films which comprise relatively small grain, high chloride emulsions (e.g., emulsions having average grain size equivalent circular diameters of less than about 1 micron and halide contents of greater than 50 mole % chloride) as discussed above in order to optimize print image quality and enable rapid processing typically result in relatively low speed photographic elements in comparison to camera negative origination films. Low speed is compensated for by the use of relatively high intensity print lamps or lasers for exposing such print elements. For comparison purposes, it is noted that motion picture color print films, e.g., when rated using the same international standards criteria used for rating camera negative films, would typically have an ISO speed rating of less than 10, which is several stops slower than the slowest camera negative films in current use. The emulsions typically will be gelatin emulsions although other hydrophilic colloids can be used in accordance with usual practice.

Couplers that may be used in the elements of the invention include those which can be defined as being 4-equivalent or 2-equivalent depending on the number of atoms of $Ag^+$ required to form one molecule of dye. A 4-equivalent coupler can generally be converted into a 2-equivalent coupler by replacing a hydrogen at the coupling site with a different coupling-off group. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in U.K. Patents and published Application Nos. 1,466,728; 1,531,927; 1,533,039; 2,006,755A and 2,017,704A, the disclosures of which are incorporated herein by reference.

Couplers that form cyan dyes upon reaction with oxidized color developing agents which can be included in elements of the invention are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler-Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948.

Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler-Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent Applications 176,804; 177,765; U.S. Pat. Nos. 4,659,652; 5,066,575; and 5,250,400.

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler-Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

To control the migration of various components coated in a photographic layer, including couplers, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to a polymeric backbone.

The compositions of typical light sensitive image recording layers used in print films are well known, and are not critical to the invention, as any of the silver halide materials used in conventional motion picture films may be used, such as those described, e.g., in *Research Disclosure*, Item 36544, September, 1994, published by Kenneth Mason Publications, Ltd., Dudley House, 12 North Street, Emsworth, Hampshire P010 7DQ, ENGLAND, and the references listed therein. In the following discussion of suitable materials for use in the emulsions and elements that can be used in conjunction with the invention, reference will be made to *Research Disclosure*, September 1994, Item 36544, which will be identified hereafter by the term "Research Disclosure." The contents of the Research Disclosure, including the patents and publications referenced therein, are incorporated herein by reference, and the Sections hereafter referred to are Sections of the Research Disclosure, Item 36544.

The silver halide emulsions employed in the elements of this invention will be negative-working emulsions. Suitable silver halide emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing conditions can be found in Sections XI–XX. It is also contemplated that the materials and processes described in an article titled "Typical and Preferred Color Paper, Color Negative, and Color Reversal Photographic Elements and Processing," published in Research Disclosure, February 1995, Item 37038 also may be advantageously used with elements of the invention. If desired, the photographic elements of the invention can be used in conjunction with an applied magnetic layer as described in Research Disclosure, November 1992, Item 34390.

In accordance with photographic elements of the invention, an antistatic layer is present which comprises vanadium pentoxide, preferably dispersed with a polymeric binder. The preparation of an antistatic layer from a composition of vanadium pentoxide colloidal gel is described in, e.g., U.S. Pat. Nos. 4,203,769; 5,006,451; 5,221,598; and 5,368,995, the disclosures of which are hereby incorporated by reference. The antistatic layer may be present on either side or both sides of the support material. The antistatic layer may be an internal layer that underlies an antihalation undercoat, protective overcoat, protective backcoat or the emulsion layers. Alternatively, the antistatic layer may be an outermost layer in which the electrically conductive material is included in the protective overcoat or protective backcoat. Preferably, the antistatic layer is present on the back side of the support, opposite to that of the emulsion layers. Antistatic layers containing vanadium pentoxide provide excellent protection against static charge and have the advantage of excellent transparency and their performance is not significantly dependent on ambient humidity. The excellent performance of these antistatic layers results from the particular morphology of this material. The colloidal vanadium pentoxide gel consists of entangled, high aspect ratio, flat ribbons about 50–100 angstroms wide, about 10 angstroms thick and about 1000–10,000 angstroms long. Low surface resistivities can be obtained with very low vanadium pentoxide coverage as a result of this high aspect ratio morphology. The antistatic layer is preferably process surviving, and may include a protective overcoat layer to provide abrasion resistance and/or enhanced frictional characteristics. Typically the dried coating weight of the vanadium pentoxide antistatic material is about 0.5 to 30 mg/m$^2$. The weight ratio of polymer binder to vanadium pentoxide can range from about 1:5 to 500:1, but is preferably from 1:1 to 10:1. Typically, the antistatic layer is coated at a dry coverage of from 1 to 1000 mg/m$^2$ based on total dry weight. The electrical resistivity of the antistatic layer is preferably from about 7 to about 11 log$\Omega/\square$, more preferably from about 8 to 10 log$\Omega/\square$, and most preferably from about 8.5 to 9.5 log$\Omega/\square$.

Preferred binders which may be included in the antistatic layer of the photographic elements of the invention include vinylidene chloride-containing polymer latexes and polyesterionomer dispersions, which can improve the integrity of the antistatic layer and the adhesion of the layer to the support. Polyesterionomers refers to polyesters that contain at least one ionic moiety. Such ionic moieties function to make the polymer water dispersible. These polymers are prepared by reacting one or more dicarboxylic acids or their functional equivalents such as anhydrides, diesters, or diacid halides with one or more diols in melt-phase polycondensation reactions well known in the art as shown in U.S. Pat. Nos. 3,018,272; 3,929,489; 4,307,174; and 4,419,437. Examples of this class of polymers include, for example, Eastman AQ™ polyesterionomers manufactured by Eastman Chemical Company.

Photographic print film elements of the invention further comprise a raw stock keeping stabilizer compound present in at least one emulsion layer or a hydrophilic colloid layer in reactive association with at least one emulsion layer, wherein the stabilizer compound comprises $Au_2S$ or a tetrachloroaurate(3+) salt of the formula $MAuCl_4$ where M represents H, Na, or K at a total coverage of at least 0.05 mg/M$^2$, preferably at least 0.1 mg/m$^2$, and most preferably from 0.1 to 100 mg/m$^2$, which levels have been found to be effective to improve keeping performance of motion picture print film elements comprising vanadium pentoxide antistatic layers. At coverages below such levels, keeping performance is not significantly improved, while at coverages above such levels, other sensitometric performance measure may be negatively impacted. While tetrachloroaurate(3+) and gold sulfide salts are well known as chemical sensitizing agents, neither have been previously suggested as being effective for addressing the particular kind of keeping failure that is created by the presence of such an antistatic layer in motion picture color print films. Use of such compounds as stabilizer compounds in accordance with the invention is distinguished from their use as chemical sensitizers, in that when used as a chemical sensitizer, they will typically be used at levels less than 0.01 mg/m$^2$, well below the levels needed to be affective as a keeping stabilizer compound. Further, when used as a sensitizer such compounds are typically added directly to the emulsion before spectral sensitizers and require heat to activate the sensitizing effect of the gold. In contrast, when used as a keeping aid in accordance with the present invention, they may be added to a hydrophilic colloid layer just before coating and requires no heat to be activated. Finally, when used at significantly lower levels than that required by the present invention, such compounds only affect the emulsion to which it is added. When added at significantly higher levels as a keeping stabilizer in accordance with the invention, on the other hand, the compound may affect the keeping performance of multiple emulsion layers. The success of the specified compounds as keeping stabilizers for color print film elements comprising vanadium pentoxide antistatic layers without otherwise substantially negatively impacting the sensitometric performance of such elements is surprising as other gold or sulfide salt compounds have been found to be ineffective as demonstrated in the examples below.

In accordance with a preferred embodiment of this invention, an antihalation undercoat layer is present as part of a subbing layer unit between the support and the emulsion layers, and is used to prevent light from being reflected into the silver halide emulsion layer(s) and thereby causing an undesired spreading of the image which is known as halation. Any of the filter dyes known to the photographic art can be used in the present invention as a means of reducing halation. Thus, for example, water-soluble dyes can be used for this purpose. Such dyes should be incorporated in the antihalation undercoat with a mordant to prevent dye diffusion. Alternatively, and preferably, a solid particle filter dye is incorporated in the antihalation undercoat.

Useful water-soluble filter dyes include the pyrazolone oxonol dyes of U.S. Pat. No. 2,274,782, the solubilized diaryl azo dyes of U.S. Pat. No. 2,956,879, the solubilized styryl and butadienyl dyes of U.S. Pat. Nos. 3,423,207 and 3,384,487, the merocyanine dyes of U.S. Pat. No. 2,527,583, the merocyanine and oxonol dyes of U.S. Pat. Nos. 3,486,897; 3,652,284 and 3,718,472, the enamino hemioxonol dyes of U.S. Pat. No. 3,976,661, the cyanomethyl sulfone-derived merocyanines of U.S. Pat. No. 3,723,154, the thiazolidones, benzotriazoles, and thiazolothiazoles of U.S. Pat. Nos. 2,739,888; 3,253,921; 3,250,617 and 2,739,971, the triazoles of U.S. Pat. No. 3,004,896, and the hemioxonols of U.S. Pat. Nos. 3,125,597 and 4,045,229. Useful mordants are described, for example, in U.S. Pat. Nos. 3,282,699; 3,455,693; 3,438,779 and 3,795,519.

Preferred examples of solid particle filter dyes for use in antihalation undercoat layers include those which are substantially insoluble at aqueous coating pH's of less than 7, and readily soluble or decolorizable in aqueous photographic processing solutions at pH of 8 or above, so as to be removed from or decolorized in a photographic element upon photographic processing. By substantially insoluble is meant dyes having a solubility of less than 1% by weight, preferably less than 0.1% by weight. Such dyes are generally of the formula:

$$D\text{-}(X)_n$$

where D represents a residue of a substantially insoluble compound having a chromophoric group, X represents a group having an ionizable proton bonded to D either directly or through a bivalent bonding group, and n is 1–7. The residue of a compound having a chromophoric group may be selected from conventional dye classes, including, e.g., oxonol dyes, merocyanine dyes, cyanine dyes, arylidene dyes, azomethine dyes, triphenylmethane dyes, azo dyes, and anthraquinone dyes. The group having an ionizable proton preferably has a pKa (acid dissociation constant) value measured in a mixed solvent of water and ethanol at 1:1 volume ratio within the range of 4 to 11, and may be, e.g., a carboxyl group, a sulfonamido group, a sulfamoyl group, a sulfonylcarbamoyl group, a carbonylsulfamoyl group, a hydroxy group, and the enol group of a oxonol dye or ammonium salts thereof. The filter dye should have a log P hydrophobicity parameter of from 0–6 in its non-ionized state. Such general class of ionizable filter dyes is well known in the photographic art, and includes, e.g., dyes disclosed for use in the form of aqueous solid particle dye dispersions as described in International Patent Publication WO 88/04794, European patent applications EP 594 973; EP 549 089; EP 546 163 and EP 430 180; U.S. Pat. Nos. 4,803,150; 4,855,221; 4,857,446; 4,900,652; 4,900,653; 4,940,654; 4,948,717; 4,948,718; 4,950,586; 4,988,611; 4,994,356; 5,098,820; 5,213,956; 5,260,179 and 5,266,454; the disclosures of each of which are herein incorporated by reference. Such dyes are generally described as being insoluble in aqueous solutions at pH below 7, and readily soluble or decolorizable in aqueous photographic processing solutions at pH 8 or above.

Preferred dyes of the above formula include those of formula:

$$[D\text{-}(A)y]X_n$$

where D, X and n are as defined above, and A is an aromatic ring bonded directly or indirectly to D, y is 0 to 4, and X is bonded either on A or an aromatic ring portion of D. Exemplary dyes of the above formulas include those in Tables I to X of WO 88/04794, formulas (I) to (VII) of EP 0 456 163 A2, formula (II) of EP 0 594 973, and Tables I to XVI of U.S. Pat. No. 4,940,654 incorporated by reference above.

To promote adhesion of the antihalation undercoat to the support, primer layers as hereinabove described are advantageously employed, especially when the support is a polyester support.

Antihalation layers which may be used in accordance with preferred embodiments of the invention may alternatively comprise metallic silver or non-photosensitive silver salts of the types previously proposed for use in photographic element antihalation and filter layers, such as described, e.g., in U.S. Pat. Nos. 1,905,188; 2,171,911; 2,571,688; 2,921,914; and 5,246,823, the disclosures of which are hereby incorporated by reference. These include, e.g., Carey-Lea yellow colloidal silver (conventionally used in yellow filter layers), Pechmann blue colloidal silver (U.S. Pat. No. 2,921,914), gray silver (see James, The Theory of the Photographic Process, 4th Ed., p.579), and tabular silver grains (U.S. Pat. No. 5,246,823). The use of conventional gray silver antihalation layers is particularly preferred. Conventional gray silver may be formed by precipitation of silver chloride and the addition of a fogging developer to produce filamentary silver similar to the morphology customarily encountered when conventional silver halide films are processed in a black-and-white developer.

As described above, the filter dyes and/or silver used in antihalation layers are preferably designed to be solubilized and removed or decolorized during photographic processing. Conventional processing of photographic print elements include the Kodak ECP-2D Process for motion picture print films, described in Kodak Publication No. H-24, Manual For Processing Eastman Color Films, the disclosure of which is hereby incorporated by reference.

The motion picture film elements in accordance with the present invention can contain additional auxiliary layers conventional in photographic elements, such as spacer layers, filter layers, pH lowering layers (sometimes referred to as acid layers and neutralizing layers), magnetic recording layers, timing layers, barrier layers, antistatic layers, and outermost protective overcoat and backcoat layers. The film elements can contain addenda conventional in the photographic art. Useful addenda are described, for example, in =Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like. Outermost protective overcoat and backcoat layers typically comprise film-forming binder and matting agent. The film-forming binder can be essentially any known polymeric binder. This includes hydrophilic colloids such as gelatin as well as hydrophobic polymers.

To provide protection of the antistatic layer in the elements of the invention, a protective overcoat is preferably applied thereon. The protective layer can chemically isolate the antistatic layer and also serve to provide scratch and abrasion resistance. The protective overcoat layers may be, e.g., cellulose esters, cellulose nitrate, polyesters, acrylic and methacrylic copolymers and, homopolymers, polycarbonates, polyvinyl formal polymethyl methacrylate, polysilicic acid, polyvinyl alcohol, and polyurethanes. Such layers may be aqueous coated or organic solvent coated as appropriate. The antistatic layer may also be overcoated with a barrier layer comprising a latex polymer having hydrophilic functionality as disclosed in U.S. Pat. No. 5,006,451 if desired. Such barrier layers provides excellent adhesion between vanadium pentoxide antistatic layers and overlying layers. A protective topcoat may also be preferably used as described in U.S. Pat. No. 5,679,505, the disclosure of which is incorporated by reference herein, which comprises a polyurethane binder and a lubricant, where the polyurethane binder has a tensile elongation to break of at least 50% and a Young's modulus measured at 2% elongation of at least 50,000 $lb/in^2$.

The chemical resistance of the antistatic layer or an overcoat can be improved by incorporating a polymer cross-linking agent into the antistatic layer or those overcoats that have functionally cross-linkable groups. Cross-linking agents such as aziridines, carbodiimide, epoxys, and the like are suitable for this purpose.

A suitable lubricant may also be included in the antistatic layer or protective overcoat in order to provide desired friction performance to assure good transport characteristics during manufacturing and handling of the elements of the invention. Many lubricating agents can be used including higher alcohol esters of fatty acids, higher fatty acid calcium salts, metal stearates, silicone compounds, paraffins and the like. Suitable lubricants include silicone oil, silicones having polar groups, fatty acid-modified silicones, fluorine-containing silicones, fluorine-containing alcohols, fluorine-containing esters, polyolefins, polyglycols, alkyl phosphates and alkali metal salts thereof, alkyl sulfates and alkali metal salts thereof, polyphenyl ethers, fluorine-containing alkyl sulfates and alkali metal salts thereof, monobasic fatty acids having 10 to 24 carbon atoms (which may contain unsaturated bonds or may be branched) and metal salts thereof (such as Li, Na, K and Cu), monovalent, divalent, trivalent, tetravalent, pentavalent and hexavalent alcohols having 12 to 22 carbon atoms (which may contain unsaturated bonds or may be branched), alkoxy alcohols having 12 to 22 carbon atoms, mono-, di- and tri-esters of monobasic fatty acids having 10 to 24 carbon atoms (which may contain unsaturated bonds or may be branched) and one of monovalent, divalent, trivalent, tetravalent, pentavalent and hexavalent alcohols having 2 to 12 carbon atoms (which may contain unsaturated bonds or may be branched), fatty acid esters of monoalkyl ethers of alkylene oxide polymers, fatty acid amides having 8 to 22 carbon atoms and aliphatic amines having 8 to 22 carbon atoms. Specific examples of these compounds (i.e., alcohols, acids or esters) include lauric acid, myristic acid, palmitic acid, stearic acid, behenic acid, butyl stearate, oleic acid, linolic acid, linolenic acid, elaidic acid, octyl stearate, amyl stearate, isooctyl stearate, octyl myristate, butoxyethyl stearate, anhydrosorbitan monostearate, anhydrosorbitan distearate, anhydrosorbitan tristearate, pentaerythrityl tetrastearate, oleyl alcohol and lauryl alcohol. Aqueous dispersed lubricants are preferred as they may be directly incorporated into an aqueous antistatic or overcoat layer, thus avoiding the need for a separately applied lubricant layer. The aqueous dispersed lubricants of camauba wax and stearates are preferred for their effectiveness in controlling friction at low lubricant levels and their excellent compatibility with aqueous overcoat polymer solutions.

Matting agents may also be included in the antistatic layer or overcoat thereon in order to improve transport properties of the elements of the invention on manufacturing, printing, processing, and projecting equipment. Such matting agents can also help prevent sticking between the front and back sides of the elements in a tightly wound roll. Matting agents may be, e.g., silica, calcium carbonate, other mineral oxides, glass spheres, ground polymers and high melting point waxes, and polymeric matte beads.

The antistatic layer may also contain a coating aid to improve coatability, including anionic or nonionic coating aids such as para-isononylphenoxyglycidol ethers, octylphenoxy polyethoxy ethanol, sodium salt of alkylaryl polyether sulfonate, and dioctyl esters of sodium sulfosuccinic acid. Such coating aids are typically used at from 0.01 to 0.30 weight percent based on the total coating solution weight.

Photographic elements of the present invention are motion picture print film elements. Such elements typically have a width of up to 100 millimeters (or only up to 70 or 50 millimeters), and a length of at least 30 meters (or optionally at least 100 or 200 meters). The original record to be reproduced is preferably an image composed of sub-records having radiation patterns in different regions of the spectrum. Typically it will be a multicolor record composed of sub-records formed from cyan, magenta and yellow dyes. The principles by which such materials form a color image are described in James, The Theory of the Photographic Process, Chapter 12, Principles and Chemistry of Color Photography, pp 335–372, 1977, Macmillan Publishing Co. New York. Materials in which such images are formed can be exposed to an original scene in a camera, or can be duplicates formed from such camera origination materials, e.g., records formed in color negative intermediate films. Alternatively, the original record may be in the form of electronic image data, which may be used to control a printer apparatus, such as a laser printer, for selective imagewise exposure of a print film in accordance with the invention.

Print films in accordance with the invention may be exposed under normal printing conditions which may be indicated with the film or other manufacturer recommendations, and processed according to standard processing conditions indicated with the film or its packaging. Alternative processing techniques, however, can also be used with films according to the invention if desired. By "indicated" in relation to the film printing and processing conditions, means that some designation is provided on the film or its packaging or associated with one or the other, which allows the user to ascertain the manufacturer's recommended printing and/or film processing conditions. Such a designation can be an actual statement of the recommended printing or processing conditions or reference to a well-known standard method (for example, the Kodak ECP-2B process for motion picture print films). Alternatively, such a designation can be a film identification designation (such as a number or film name) which allows a user to match the film with the manufacturer's recommended printing or processing conditions (such as from a catalogue, brochure or other source).

The following examples illustrate preparation of photographic elements of the present invention, and their beneficial characteristics.

COMPARATIVE EXAMPLE 1

A comparison multilayer photographic print element (Element 1A) was prepared by coating the following layers as described below on a gelatin subbed polyethylene terephthalate support. All units unless otherwise specified are in mg/m$^2$. The support was coated on the backside with a vanadium pentoxide antistatic backing layer overcoated with a polyurethane layer similarly as described in U.S. Pat. No. 5,679,505. Specifically, subbed polyethylene terephthalate supports were prepared by applying a subbing terpolymer of acrylonitrile, vinylidene chloride and acrylic acid to both sides of a polyester film, and subsequently drafting and tentering the film so that the final coating weight was about 90 mg/m$^2$. An antistatic layer formulation was then coated on one side of the subbed polyester support. The antistat layer consisted in dry coverages of 2.8 mg/m$^2$ of an acrylonitrile/vinylidene chloride/acrylic acid terpolymer, 2.15 mg/m$^2$ vanadium pentoxide, and 3.23 mg/m$^2$ Olin 10G surfactant. A protective topcoat was used to overcoat the antistatic layer. The topcoat consisted in dry coverage of 972 mg/m$^2$ of Sancure 898 polyurethane, 26.9 mg/m$^2$ of 2 $\mu$m polymethyl methacrylate matte beads, 60.7 mg/m$^2$ polyfunctional aziridine crosslinker, and 9.7 mg/m$^2$ Triton X-100 surfactant (Rohm & Haas), as well as 13.5 mg/m$^2$ Michemlube 124 (Michelman Inc.) synthetic hydrocarbon wax and 14.5 mg/m$^2$ Fluorotenside FT-248 (Bayer A G) tetraethylammonium salt of perfluorooctyl sulfonic acid.

| Description of Element 1A | |
|---|---|
| Protective Overcoat | |
| Gelatin | 976 |
| Polydimethylsiloxane lubricant (Dow Corning) | 16 |
| Polymethylmethacrylate beads | 16 |
| Spreading Aids | |
| Green Emulsion Layer | |
| AgClBr cubic grain emulsion, 1.35% Br, 0.14 micron, spectrally sensitized with green sensitizing dye GSD-1, 0.363 mmole/Ag mole, and green sensitizing dye GSD-2, 0.012 mmole/Ag mole. | 75.9 |
| AgClBr cubic grain emulsion, 1.2% Br, 0.18 micron, spectrally sensitized with green sensitizing dye GSD-1, 0.293 mmole/Ag mole, and green sensitizing dye GSD-2, 0.009 mmole/Ag mole. | 354 |
| AgClBr cubic grain emulsion, 1.7% Br, 0.26 micron, spectrally sensitized with green sensitizing dye GSD-1, 0.273 mmole/Ag mole, and green sensitizing dye GSD-2, 0.008 mmole/Ag mole. | 75.9 |
| Magenta Dye Forming Coupler M-1 | 657 |
| Green Filter Dye GFD-1 | 14 |
| Green Filter Dye GFD-2 | 32 |
| Oxidized Developer Scavenger Scav-1 | 12 |
| Gelatin | 1507 |
| Interlayer | |
| Oxidized Developer Scavenger Scav-1 | 86 |
| Gelatin | 610 |

-continued

| Description of Element 1A | |
|---|---|
| Spreading aids | |
| Red Emulsion Layer | |
| AgClBr cubic grain emulsion, 0.8% Br, 0.14 micron, spectrally sensitized with red sensitizing dye RSD-1, 0.042 mmole/Ag mole. | 117.5 |
| AgClBr cubic grain emulsion, 0.9% Br, 0.18 micron, spectrally sensitized with red sensitizing dye RSD-1, 0.044 mmole/Ag mole. | 218.5 |
| AgClBr cubic grain emulsion, 0.9% Br, 0.26 micron, spectrally sensitized with red sensitizing dye RSD-1, 0.050 mmole/Ag mole. | 70 |
| Cyan dye forming coupler C-1 | 888 |
| Red Absorber Dye Pina TM Filter Blue Green (Riedel-de Haen Company) | 68 |
| Gelatin | 3122 |
| Interlayer | |
| Oxidized Developer Scavenger Scav-1 | 86 |
| Gelatin | 610 |
| Spreading Aids | |
| Blue Emulsion Layer | |
| AgClBr cubic grain emulsion, 0.4% Br, 0.40 micron, spectrally sensitized with blue sensitizing dye BSD-1, 0.151 mmole/Ag mole and blue sensitizing dye BSD-2, 0.149 mmole/Ag mole. | 259 |
| AgClBr cubic grain emulsion, 0.5% Br, 0.50 micron, spectrally sensitized with blue sensitizing dye BSD-1, 0.219 mmole/Ag mole and blue sensitizing dye BSD-2, 0.217 mmole/Ag mole. | 370 |
| AgClBr cubic grain emulsion, 0.3% Br, 0.90 micron, spectrally sensitized with blue sensitizing dye BSD-1, 0.124 mmole/Ag mole and blue sensitizing dye BSD-2, 0.122 mmole/Ag mole. | 167 |
| Yellow Coupler (Y-1) | 1290 |
| Blue filter dye BFD-1 | 31 |
| Metal Ion Sequestrant Seq-1 | 43 |
| Metal Ion Sequestrant Seq-2 | 22 |
| Yellow Preformed Dye YPD-1 | 8 |
| Gelatin | 2476 |
| Antihalation Layer | |
| Antihalation Filter Dye AFD-1 | 53 |
| Antihalation Filter Dye AFD-2 | 120 |
| Gelatin | 700 |
| Spreading aids | |
| Support | |
| Transparent polyethylene terephthalate support with polyurethane overcoated vanadium pentoxide antistatic layer on the back of the film base which provides process surviving antistatic properties | |

The following structures represent compounds utilized in the above described photographic element:

Green sensitizing dye GSD-1

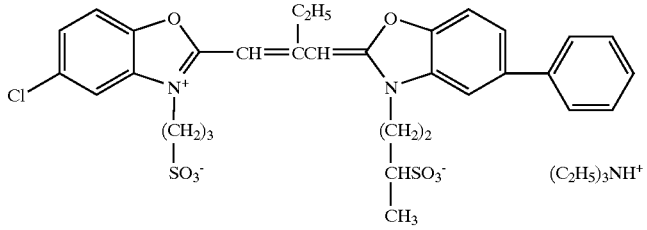

-continued
Green sensitizing dye GSD-2
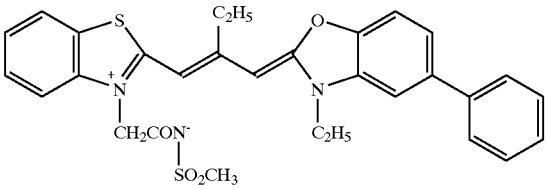
Magenta coupler M-1
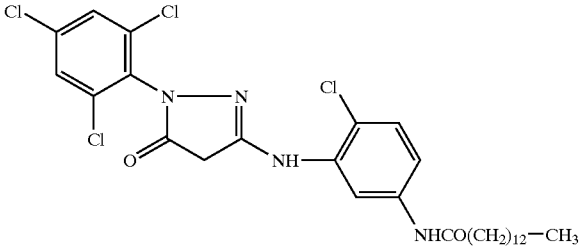
Green Filter Dye GFD-1
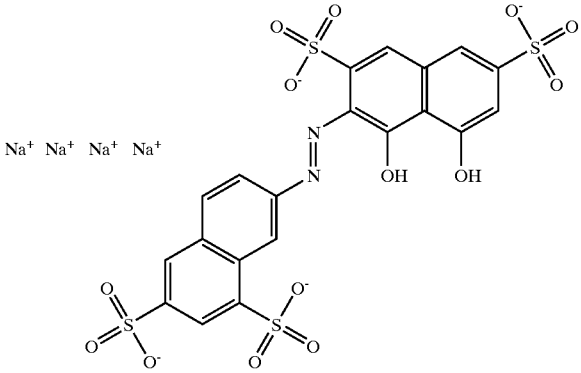
Green Filter Dye GFD-2
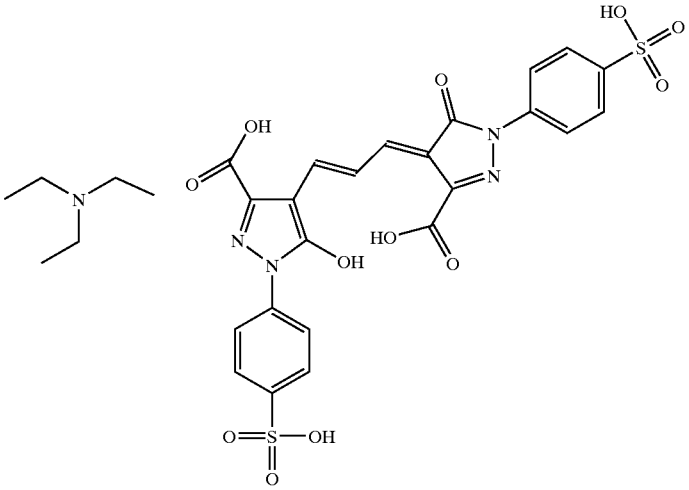
Scavenger Scav-1
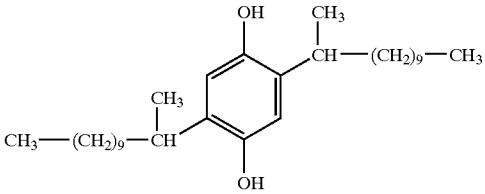

-continued
Yellow Preformed Dye YPD-1
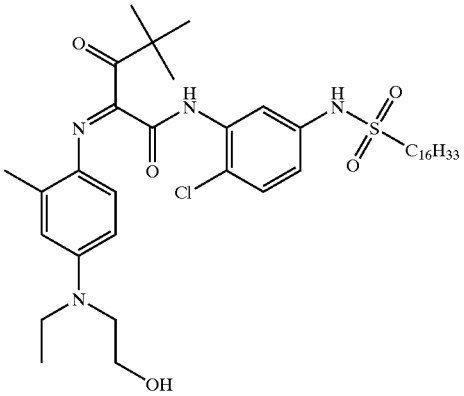
Red sensitizing dye RSD-1
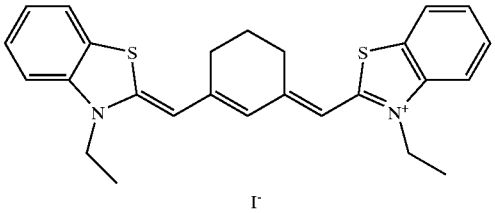
Cyan coupler C-1
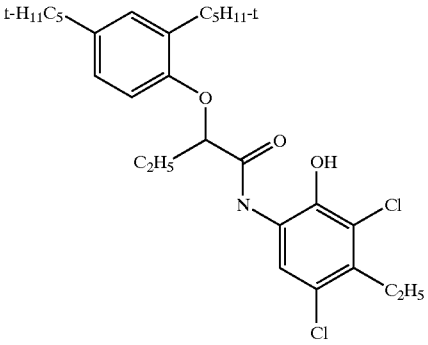
Blue sensitizing dye BSD-1
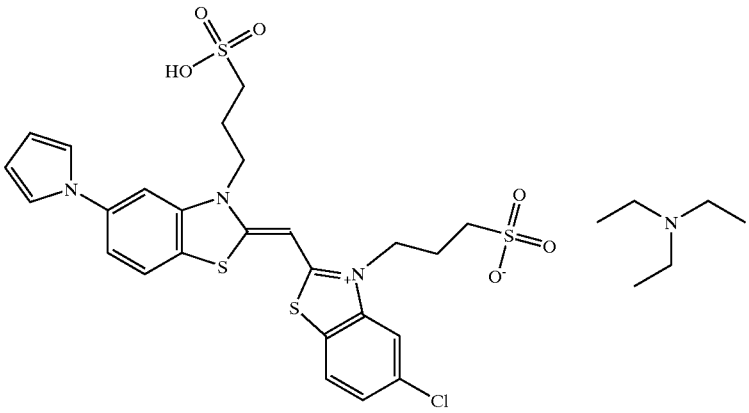

-continued
Blue sensitizing dye BSD-2
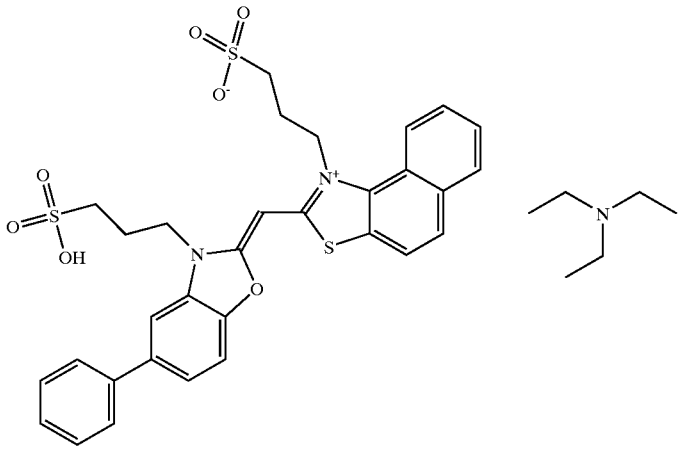
Yellow coupler Y-1
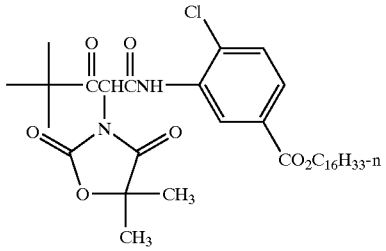
Blue filter dye BFD-1
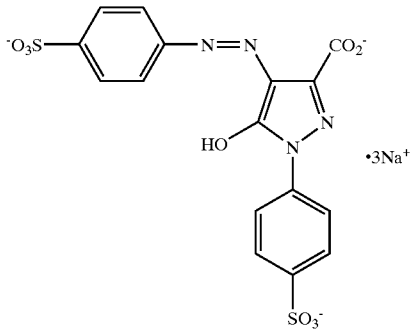
Sequestrant Seq-1
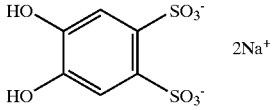
Sequestrant Seq-2
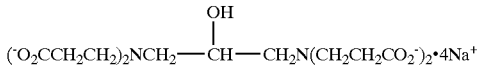
Antihalation filter dye AFD-1
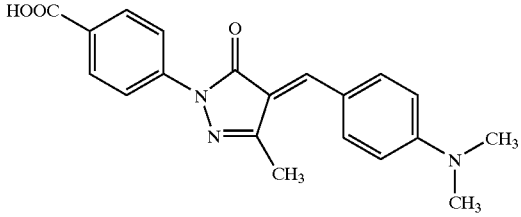

-continued

Antihalation filter dye AFD-2

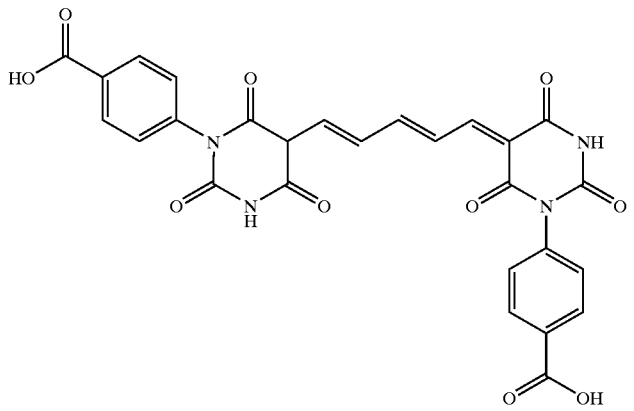

A second comparison multilayer photographic print element (Element 1B) was also prepared having the same composition on the emulsion layer side of the support as Element 1A, but a carbon black "rem-jet" backed support was used rather than a support having a vanadium pentoxide antistatic layer.

Each element also contained bis-vinylsulfonylmethane (BVSM) as a gelatin hardener. Couplers were dispersed with high-boiling coupler solvents and/or auxiliary solvents in accordance with conventional practice in the art.

Samples of each print film were exposed for 1/500s on a 1-B sensitometer with a 3200K light source and a 0–3 LogE step tablet. The coatings were processed in the standard color print process ECP-2D as described in the Kodak Publication H-24, Module 9; using a persulfate bleach and without any sound track application. To replicate wound roll storage conditions, stacks of several strips of each print film were incubated, and then an internal strip from each stack was similarly exposed and processed. Without incubation the densities at step 14 would be 3.40 red, 3.28 green, and 3.36 blue (Status A). The changes in Dmin, and step 14 densities after incubation for 1 week at 120F and 55% RH, are compared to a frozen check and reported in Table 1.

TABLE 1

The effect of the antistatic backing on incubation

| | Change in Dmin | | | Change density at step 14 | | |
|---|---|---|---|---|---|---|
| Element | Cyan | Magenta | Yellow | Cyan | Magenta | Yellow |
| 1A | 0.02 | 0.01 | 0.01 | −0.30 | −0.30 | 0.00 |
| 1B | 0.01 | 0.01 | 0.0 | 0.03 | 0.02 | 0.02 |

The above results demonstrate the effect of vanadium pentoxide antistatic layers on keeping performance for color print films.

EXAMPLE 2

Comparative Elements 2A–2G and Inventive Elements 2H–2I

Additional Elements 2A–2I designed to demonstrate the effect of various added compounds on keeping performance were prepared in a bi-layer format identical to Element 1A, except the Blue Emulsion Layer was omitted, and the gelatin coated in the antihalation layer was increased to 2313 mg/m$^2$. In addition to palladium compound P-1 of U.S. Pat. No. 5,650,265, a variety of candidates were evaluated for their ability to enhance raw stock stability, including $K_3Ir_6.3H_2O$, gold salts $KAuCl_4$ and $Au_2S$ in accordance with the invention, comparison organic gold salt 1, comparison organic gold salt 2, comparison organic disulfide compound 3, and $Na_3Au(S_2O_3)_2$. Structures of the comparison organic compounds are given below.

Organic Gold Salt 1

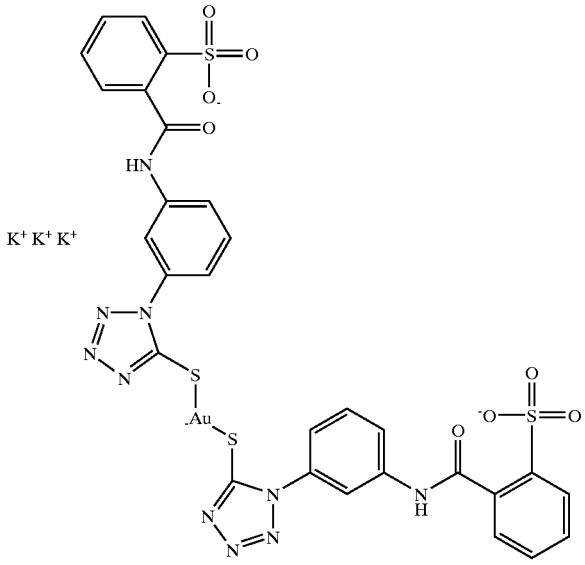

Organic Gold Salt 2

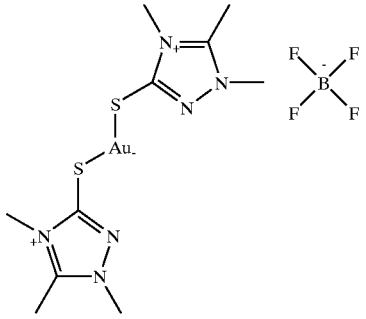

-continued

Organic compound 3

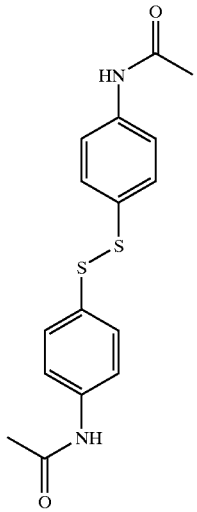

Comparison Element 2A contained no additional compound, while Elements 2B–2I contained comparative or inventive chemical compounds added to the cyan emulsion layer in equimolar amounts just before coating.

Samples of Elements 2A–2I were exposed and processed as in Example 1. In order for the compounds to be useful, they must not detrimentally affect the standard sensitometric response of the film. An "acceptable" minimal impact on the film speed is less than 0.05 log E change in the exposure necessary to attain a status A densitometry of 1.0. The added compounds in Elements 2B, C and D had "unacceptable" substantial negative effects on the speed of the coatings (speed changes of 0.05 log E or more for each of the cyan and magenta records), and no further testing was accordingly pursued for such compounds.

Samples of Elements with chemicals that had a minimal impact on speed were incubated similarly as in Example 1 for 1 week at 120F and 50% RH. The results of the incubation test are in Table 2. Desired changes in Dmin are ≦0.02, and desired changes in density at step 14 are ≦0.10, preferably ≦0.05.

TABLE 2

Speed and incubation effects of added compounds.

| Element (Added Compound) | Level $mg/m^2$ | Effect on speed | Change in Cyan Dmin | Change in Magenta Dmin | Change in Density at Step 14 Cyan | Change in Density at Step 14 Magenta |
|---|---|---|---|---|---|---|
| 2A - Control (None) | | Acceptable | 0.02 | 0.01 | −0.55 | −0.48 |
| 2B - Comparison ($K_3Ir_6.3H_2O$) | 1.98 | Unacceptable | | | | |
| 2C - Comparison (Organic gold salt 1) | 2.12 | Unacceptable | | | | |
| 2D - Comparison (Organic gold salt 2) | 4 | Unacceptable | | | | |
| 2E - Comparison ($Na_3Au(S_2O_3)_2$) | 1.998 | Acceptable | 0.02 | 0.02 | −1.90 | −1.26 |
| 2F - Comparison (Organic compound 3) | 1.26 | Acceptable | 0.01 | 0.02 | −0.53 | −0.48 |
| 2G - Comparison (Palladium compound P-1) | 1.08 | Acceptable | 0.01 | 0.01 | −0.02 | −0.01 |
| 2H - Invention ($KAuCl_4$) | 1.28 | Acceptable | 0.01 | 0.02 | −0.02 | −0.07 |
| 2I - Invention ($Au_2S$) | 1.61 | Acceptable | 0.01 | 0.02 | 0.05 | −0.08 |

This data clearly shows that the use of keeping stabilizer compounds in accordance with the invention may be used to improve the keeping of color print film, with performance similar to that of the more expensive palladium compound.

EXAMPLE 3

Comparisons Elements 3A–B, and Invention Elements 3C–G

Additional Elements 3A–3F were prepared in a format identical to Element 1A, except Palladium compound P-1 of U.S. Pat. No. 5,650,265 or $KAuCl_4$ was added to the cyan layer at various levels just before coating. The Elements were evaluated similarly as in Example 1.

TABLE 3

Keeping Change, Level series of $KAuCl_4$

| Element (Specified added keeping addenda) | Added Addenda Level mg/m$^2$ | Change in Dmin | | | Change density at step 14 | | |
|---|---|---|---|---|---|---|---|
| | | Cyan | Magenta | Yellow | Cyan | Magenta | Yellow |
| 1A - Control (No added keeping addenda) | 0 | 0.02 | 0.01 | 0.01 | −0.30 | −0.30 | 0.00 |
| 3A - Comparison (Palladium Compound P-1) | 0.54 | 0.01 | 0.01 | 0.01 | −0.07 | −0.06 | 0.08 |
| 3B - Comparison ($KAuCl_4$) | 0.01 | 0.02 | 0.01 | 0.0 | −0.23 | −0.24 | −0.01 |
| 3C - Invention ($KAuCl_4$) | 0.108 | 0.02 | 0.01 | 0.0 | −0.06 | −0.05 | 0.02 |
| 3D - Invention ($KAuCl_4$) | 0.54 | 0.02 | 0.01 | 0.0 | 0.04 | 0.05 | 0.04 |
| 3E - Invention ($KAuCl_4$) | 1.08 | 0.02 | 0.01 | 0.0 | 0.05 | 0.03 | 0.08 |
| 3F - Invention ($KAuCl_4$) | 1.28 | 0.01 | 0.0 | 0.0 | 0.02 | 0.02 | 0.05 |

The above data demonstrates that in order to be useful, the level of added $KAuCl_4$ must be above 0.05 mg/m$^2$ in accordance with the claimed invention.

While the invention has been described in detail with particular reference to preferred embodiments, it will be understood that variations and modifications can be effected within the spirit and scope of the invention.

What is claimed:

1. A silver halide light sensitive motion picture photographic print element comprising a support having a front side and a back side and bearing on the front side thereof in order a yellow dye image-forming unit comprising at least one blue-sensitive silver halide emulsion layer having associated therewith at least one yellow dye-forming coupler, a cyan dye image-forming unit comprised of at least one red-sensitive silver halide emulsion layer having associated therewith at least one cyan dye-forming coupler, and a magenta dye image-forming unit comprising at least one green-sensitive silver halide emulsion layer having associated therewith at least one magenta dye-forming coupler; said element further comprising an antistatic layer containing vanadium pentoxide on either side of the support, and a raw stock keeping stabilizer compound present in at least one emulsion layer or a hydrophilic colloid layer in reactive association with at least one emulsion layer, wherein the stabilizer compound comprises $Au_2S$ or a tetrachloroaurate (3+) salt of the formula $MAuCl_4$ where M represents H, Na, or K at a total coverage of at least 0.05 mg/m$^2$.

2. The element of claim 1, further comprising an antihalation layer coated between the support and the silver halide emulsion layers.

3. The element of claim 1, wherein the antistatic layer is on the side of the support opposite to the silver halide emulsion layers, and further comprising a protective polymeric overcoat layer coated over the antistatic layer.

4. The element of claim 1, wherein the stabilizer compound is $Au_2S$.

5. The element of claim 4, wherein the stabilizer compound is present at a total coverage of at least 0.1 mg/m$^2$.

6. The element of claim 5, wherein the stabilizer compound is present in the element at from 0.1 to 100 mg/m$^2$.

7. The element of claim 1, wherein the stabilizer compound is a tetrachloroaurate(3+) salt.

8. The element of claim 7, wherein the stabilizer compound is $KAuCl_4$.

9. The element of claim 8, wherein the stabilizer compound is present at a total coverage of at least 0.1 mg/m$^2$.

10. The element of claim 9, wherein the stabilizer compound is present in the element at from 0.1 to 100 mg/m$^2$.

11. The element of claim 1, wherein the stabilizer compound is present at a total coverage of at least 0.1 mg/m$^2$.

12. The element of claim 11, wherein the stabilizer compound is present in the element at from 0.1 to 100 mg/m$^2$.

13. The element of claim 12, wherein the stabilizer compound is present in the element at from 0.1 to 20 mg/m$^2$.

14. The element of claim 1, wherein the stabilizer compound is coated in a silver halide emulsion layer.

15. The element of claim 1, wherein the stabilizer compound is coated in a layer of the element other than a silver halide emulsion layer.

16. The element of claim 1, wherein each of the blue-sensitive, red-sensitive, and green-sensitive silver halide emulsion layers comprises silver halide emulsion grains having an average equivalent circular diameter of less than 1 micron and an aspect ratio of less than 1.3.

17. The element of claim 16, wherein each of the blue-sensitive, red-sensitive, and green-sensitive silver halide emulsion layers comprise silver halide emulsion grains comprising greater than 95 mole % chloride.

18. The element of claim 17, wherein each of the red-sensitive and green-sensitive silver halide emulsion layers comprise emulsion grains having an average equivalent circular diameter of less than 0.60 micron, and the blue-sensitive silver halide emulsion layer comprises emulsion grains having an average equivalent circular diameter of less than 0.90 micron.

* * * * *